US006604983B1

(12) United States Patent
Denn

(10) Patent No.: US 6,604,983 B1
(45) Date of Patent: Aug. 12, 2003

(54) BREAST SLING

(76) Inventor: Elualou Ann Denn, 301 W. 7th St., McGregor, TX (US) 76657

( * ) Notice: Subject to any disclaimer, the term of this patent is extended or adjusted under 35 U.S.C. 154(b) by 0 days.

(21) Appl. No.: 10/032,440

(22) Filed: Apr. 16, 2002

(51) Int. Cl.[7] ..... A41C 3/00
(52) U.S. Cl. ..... 450/1; 450/38; 450/57
(58) Field of Search ..... 450/1, 54, 55, 450/38, 59, 57, 60, 61, 62, 63; 602/1, 20, 60, 61, 19, 79, 75, 58

(56) References Cited

U.S. PATENT DOCUMENTS 1,417,930 A * 5/1922 Mailleue ..... 450/1
3,094,125 A * 6/1963 Lewis ..... 450/54
3,401,407 A * 9/1968 Pittman ..... 450/1
3,908,670 A * 9/1975 Dubin ..... 450/57
4,185,332 A * 1/1980 Jahnig ..... 450/54
6,402,586 B1 * 6/2002 Winik et al. ..... 450/78

* cited by examiner

*Primary Examiner*—Gloria M. Hale

(57) ABSTRACT

The front section of this garment is made of silky, stretch material sewn to a cotton backing that is split so that prosthesis can be inserted. The cup is attached to an adjustable bottom strap and an adjustable shoulder strap. The bottom strap circles the area of the body just under the breast. It can have an adjustment on two sides (right and left)—the side nearest the cup only, or on both that side and the opposite side. The breast sling could also be made without mechanical adjustments on the bottom strap and simply be made in sizes small, medium and large. A thicker strap at the bottom of the cup gives extra support to the breast. The single cup is designed for women who have had mastectomies, and the cup can be made for the right or left side. Additionally, it can be turned inside out and worn on the remaining breast by women who want such support while sleeping.

2 Claims, 4 Drawing Sheets

6
7
12
11
18
10
8
9

BREAST SLING

BACKGROUND OF THE BREAST SLING

The breast sling was designed by a breast cancer survivor to be worn by women who have had single mastectomies. Women who have had a breast removed don't always want to wear a bra but do not want to appear flat on one side. The breast sling holds the prosthesis, or breast replacement, that is normally used in their bras. It is less confining than a bra because it does not cover up the underarm area or the remaining breast. One elastic band attached to the single cup goes over the shoulder; the elastic band to which it is attached goes around the torso just under the breast area. A woman puts it on by pulling it over her head, then putting her left or right arm (determined by which breast is gone) through the opening between the shoulder strap and the torso strap. The cup can be adjusted to match the remaining breast. A side adjustment allows the wearer to determine how tight she wants it to be. The breast sling gives the wearer more freedom of movement than a regular bra. It can be worn under a housecoat or nightgown, for sleeping or normal activity. It can be worn under regular clothes, both at home and at work. Patients who have undergone radiation treatments and need to give their skin freedom to heal can wear it loosely.

SUMMARY OF THE BREAST SLING

The cup of the garment supports a breast replacement device, or prosthesis, used by breast cancer patients who have one breast remaining. The cup is attached to a shoulder strap with an adjustment sewn in so that it can be matched to the other breast. The back of the cup, made of cotton fabric, has a slit in the center for insertion of the prosthesis. The front of the cup is made of silky material and is attached along the side to the cotton backing. The silky material allows for a natural look. The shoulder strap is attached to the top of the cup and to another strap that encircles the torso right below the breast area. The portion of the strap immediately below the cup is thicker for cup support. Adjustments to the torso strap can be placed on the cup side only, or on both sides. Or the torso strap can be made without adjustment. In this case, women would wear a small, medium or large size. The wearer of the breast sling can pull it over her head or step into it, slip her arm thorough the opening between the straps, and adjust the cup to her breast.

ADVANTAGES OF THE BREAST SLING

The invention of the breast sling means a breast cancer survivor with one breast can wear a garment much less confining than a regular bra. The breast sling can be worn to bed, around the house, while working in the garden, while running errands, or answering the door. Women who want to support their remaining breast while sleeping can turn it inside out and wear it on the other side. It has a natural look and feel. The main advantage of the breast sling is that women who are trying to maintain a normal lifestyle while undergoing radiation treatment can wear it. Doctors tell women not to wear a regular bra for the duration of radiation treatment and afterwards because they want the area to be able to heal freely. The breast sling provides support and a natural look yet does not fit close to the body, leaving the irradiated area free to heal and the underarm area unconfined. The breast sling is easy to put on. It can be slipped over the head or stepped into, pulled into place and adjusted. It is taken off in the same manner.

BRIEF DESCRIPTION OF THE DRAWINGS

The objects and features of the present invention, which are believed to be novel, are set forth with particularity in the appended claims. The present invention, both to its organization and manner of operation, together with further objects and advantages, may best be understood by references to the following description, taken in connection with the accompanying drawings, wherein like reference numerals and two numeral-lettered are used throughout the several views and, in which:

Turning now to the drawings, as shown in FIGS. 1–4, is a breast sling 1–23, including 1*a* and 1*b*, a cup preferably formed in three sections and having an adjustment on shoulder strap FIGS. 1–4,2,6,15,23 and an adjustment on the mid section strap FIGS. 1–3,5,9,11. As best shown in FIGS. 1–2, the shoulder strap connects to the top of cup FIGS. 1,1*a*, then extends over the shoulder area and is attached to the bottom to the mid section strap FIGS. 2,1*b*. Front bottom of triangular cup FIGS. 1,3 is attached to the mid section strap using thicker strap FIGS. 2,8. The mid section strap can be made without the adjustments shown in FIGS. 2,9,11. The adjustment on the shoulder strap as shown in FIGS. 2,6 enables the wearer to adjust the cup FIGS. 1,3 to match the remaining breast of a mastectomy survivor. The adjustment on the mid section strap FIGS. 2,9,11 enables wearer to fit garment as loose or tight as she wishes for comfort. As shown in FIGS. 3 the backs of the cup 14,18 are made of a cotton material and are attached to the silky material of front cup FIGS. 1,3 along both outer edges connecting the two right triangles at top and bottom leaving a slit between the two right triangles FIGS. 3,16. Any garment of clothing can be worn over the breast sling such as nightgowns, housecoats or street cloths and will give the wearer the appearance of two breasts. The user, in place of a bra, may wear the breast sling of the present invention. It will be more comfortable and provides a much freer feeling than the user would have with a bra. The breast sling can be made in any various colors, decorative designs and sizes and from any desired materials as long as the front cup FIGS. 1,3 is of a stretchy-silky type and the back right triangles FIGS. 3,14, 18 are made of a cotton or cotton/polyester material.

Figure 1:
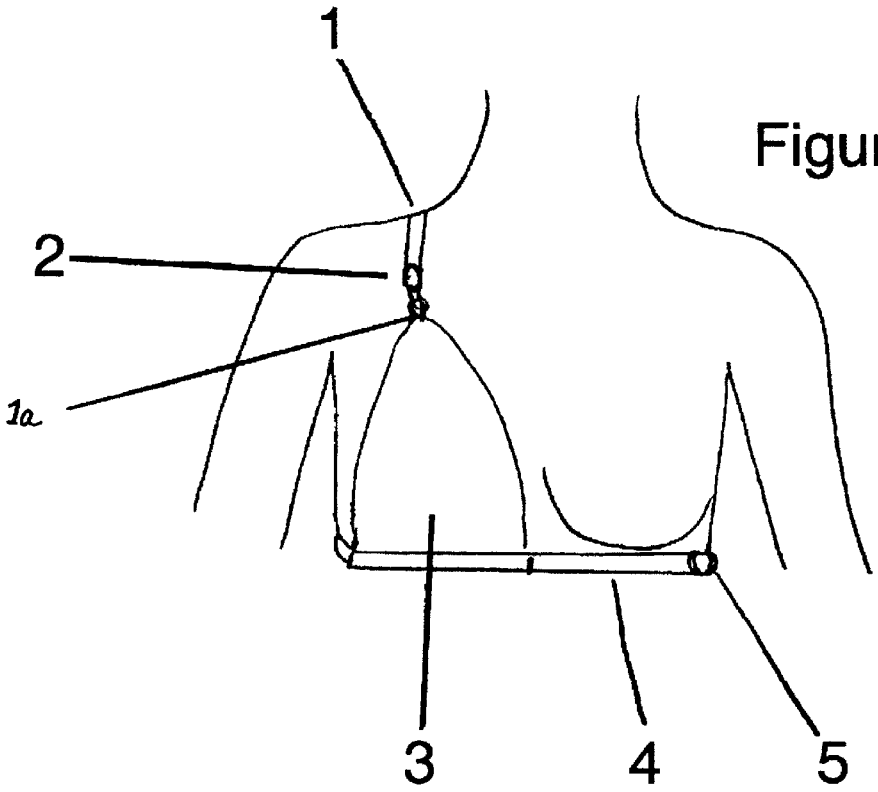
FIG. 1 Is a front view of a woman wearing the single breast sling.
Figure 2:
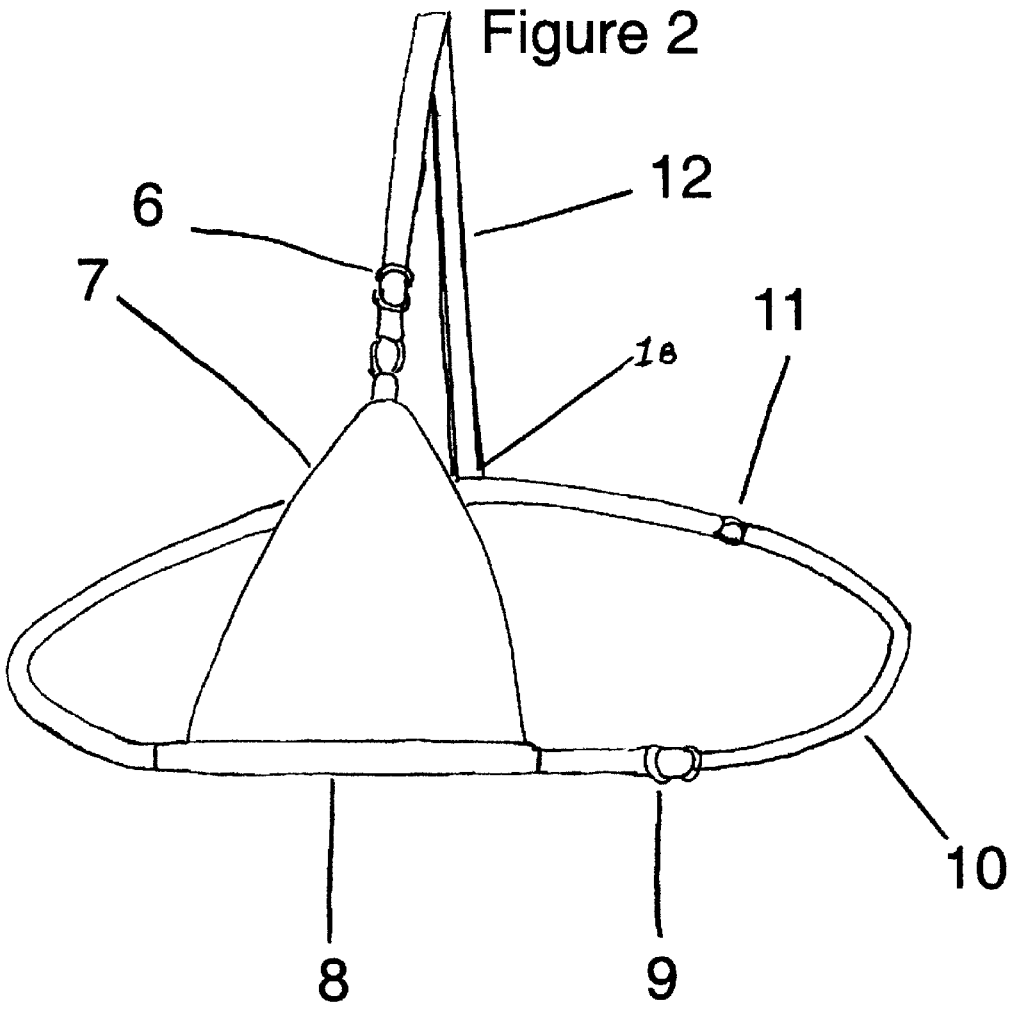
FIG. 2 Is a front view of the breast sling alone with out a woman figure. It shows the sling from all sides.
Figure 3:
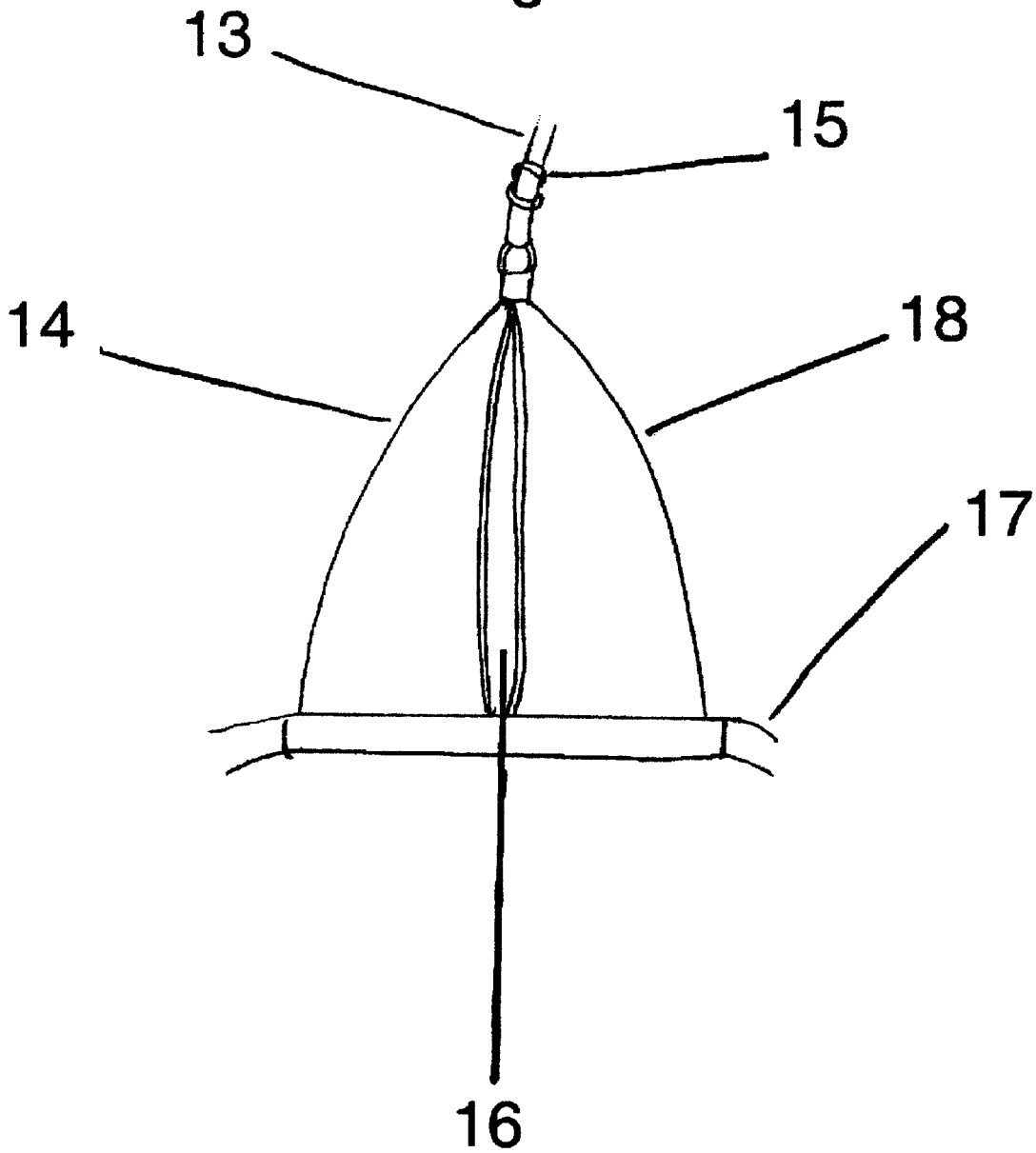
FIG. 3 Is a back view of the breast cup
Figure 4:
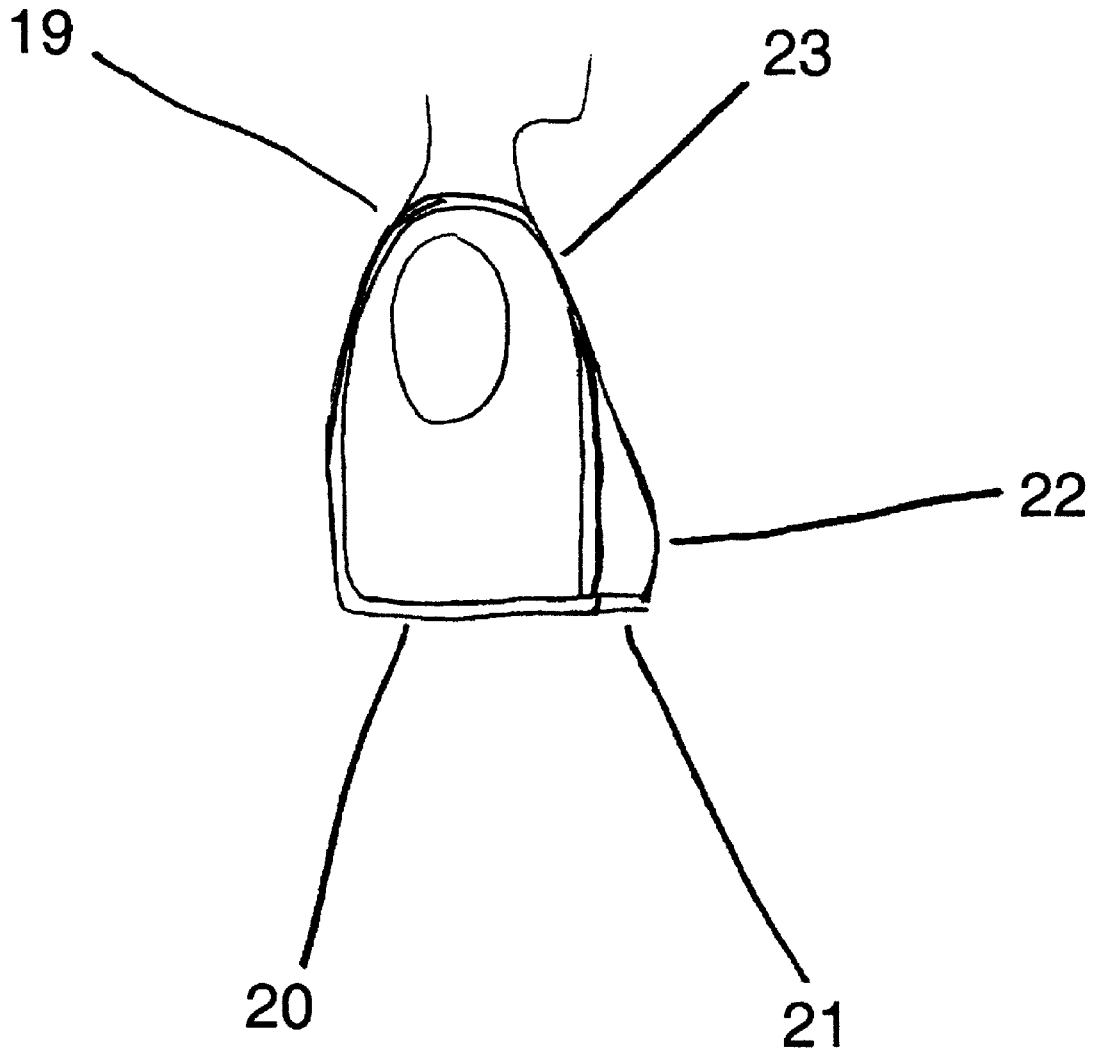
FIG. 4 Is the right side view of the breast sling, on a side view of a woman figure.

What is claimed is:

1. A breast sling for a single mastectomy prosthesis comprising:

a) a single cup including:

i. a front piece of silky stretch material in the shape of a equilateral triangle; said front piece having outer edges;

ii. two back pieces of cotton material in the shape of a right triangle; said back pieces each having out edges;

iii. the outer edges of the two back pieces are attached to the outer edges of the front piece forming the cup, leaving a slit between the back pieces of the cup to allow for inserting the prosthesis therein;

iv. Wherein the two back pieces are overlapped slightly at a top and bottom of the slit creating a flap;

b) a single adjustable mid-section strap connected to a base of the triangular cup and which is a thicker strap under the cup for support; and c) a single adjustable shoulder strap connected to a top point of the cup and to the mid-section strap.

2. A breast sling as claimed in claim 1 wherein said mid-section strap is not adjustable.

* * * * *